US007247360B1

(12) United States Patent
Besner et al.

(10) Patent No.: US 7,247,360 B1
(45) Date of Patent: Jul. 24, 2007

(54) SANITARY, PORTABLE AND DISPOSABLE TOILET SEAT COVER, WITH ATTACHED WIPE

(75) Inventors: Beth A. Besner, Davie, FL (US); James T. Beaty, Huntersville, NC (US)

(73) Assignee: Neat Solutions, Cornelius, NC (US)

( * ) Notice: Subject to any disclaimer, the term of this patent is extended or adjusted under 35 U.S.C. 154(b) by 279 days.

(21) Appl. No.: 10/620,065

(22) Filed: Jul. 15, 2003

Related U.S. Application Data

(60) Provisional application No. 60/405,662, filed on Aug. 26, 2002.

(51) Int. Cl.
*A37K 13/14* (2006.01)

(52) U.S. Cl. ..... 428/42.1; 4/245.1; 4/245.4; 4/254.7; 4/254.8; 428/40.1; 428/40.2; 428/43; 428/156

(58) Field of Classification Search ..... 428/40.1, 428/40.2, 42.3, 43, 156; 4/245.1, 245.4, 4/254.7, 254.8
See application file for complete search history.

(56) References Cited

U.S. PATENT DOCUMENTS 1,745,223 A 1/1930 Light
1,835,787 A * 12/1931 Kinely
2,313,311 A 3/1943 Arter, Jr. et al.
3,851,341 A 12/1974 Aoyama
4,572,814 A * 2/1986 Naylor et al. ..... 264/46.4
4,766,617 A * 8/1988 Thygesen et al. ..... 4/245.4
4,850,061 A 7/1989 Engel
4,875,242 A * 10/1989 Albrecht et al. ..... 4/245.4
4,887,321 A * 12/1989 MacLean ..... 4/245.5
5,144,698 A * 9/1992 McKenzie ..... 4/245.5
6,073,274 A 6/2000 McQueen
6,663,949 B1 * 12/2003 Tanaka et al. ..... 428/323

* cited by examiner

*Primary Examiner*—Nasser Ahmad
(74) *Attorney, Agent, or Firm*—Clements Walker

(57) ABSTRACT

The invention is an easy to fold sanitary toilet seat cover for preventing direct contact between an individual's skin and the top and the side surfaces of a toilet seat. When unfolded, the toilet seat cover is sufficiently large to not only cover the entire elongated toilet seat, but also cover the sides of the seat. The disposable toilet seat cover comprises a polygonal annulus that is comprised of a quilted multilayer sheet having a water impervious layer and an absorbent layer, a wipe that is a detachable inner oval section that provides an opening to the toilet, and an adhesive fastening means for temporarily securing the polygonal annulus toilet seat. The water impervious layer comprises a coated layer and/or a filmic layer. The wipe detaches from an inner ovalled edge of the annulus, and is functional as a sanitary wipe or towel.

25 Claims, 3 Drawing Sheets

Fig.6
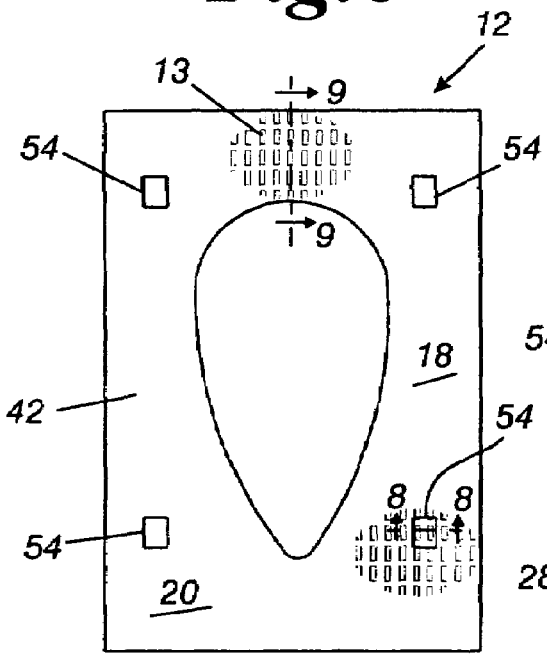
Fig.7
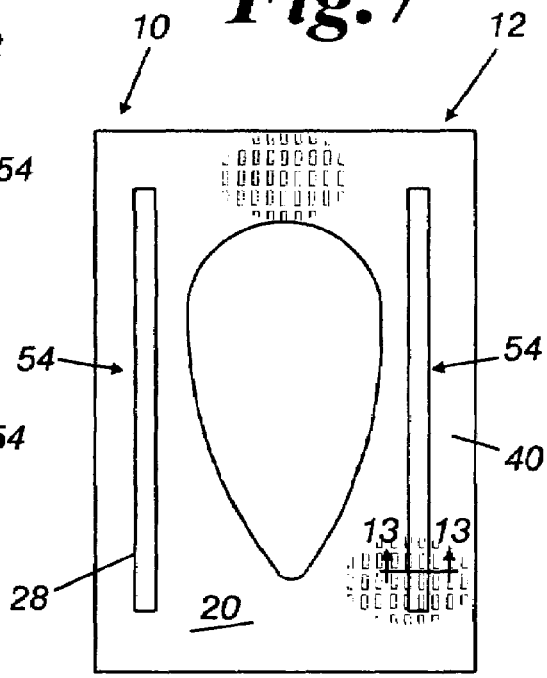
Fig.8
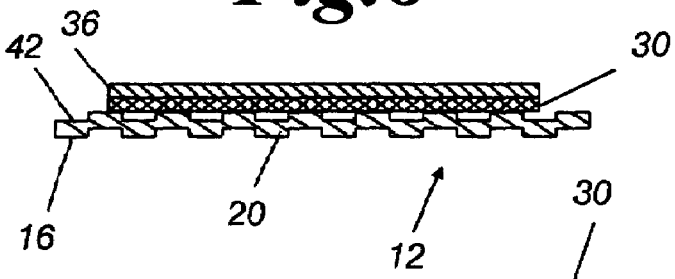
Fig.9
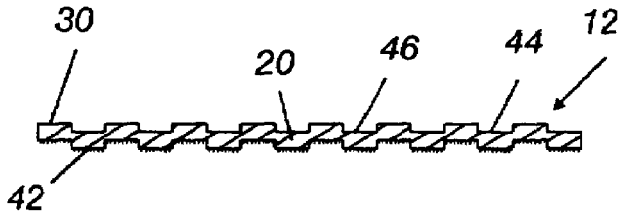
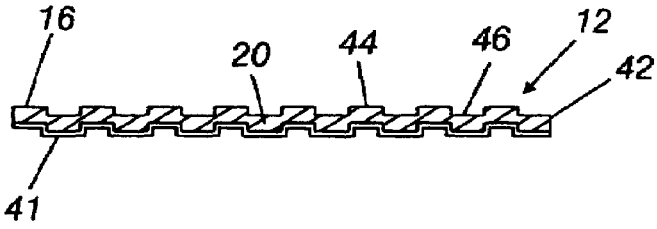
Fig 10

SANITARY, PORTABLE AND DISPOSABLE TOILET SEAT COVER, WITH ATTACHED WIPE

CROSS REFERENCE TO RELATED APPLICATION

This application claims the benefit of the earlier filed provisional patent application filed on Aug. 26, 2002, bearing the Ser. No. 60/405,662.

FIELD OF THE INVENTION

The present invention relates generally to a sanitary toilet seat cover, and in particular to a disposable sanitary toilet seat cover having an absorbent tissue with a protective barrier film and a fastening means to temporarily adhesively secure the sanitary toilet seat cover to a top surface of the seat.

BACKGROUND OF THE INVENTION

The public has been concerned with the cleanliness of toilet seats undoubtedly since the invention of the toilet seat. The issue is of particular concern with public toilets, wherein there is no knowledge of its current state of cleanliness prior to usage. Public places, such as bus stations, airports, restaurants and movie-houses, provide facilities that are used by extremely large numbers of people, and it is not practicable nor is it practiced to clean the toilet seat between uses. Consequently, these facilities, on the whole, are not clean and not esthetic. For such types of toilet facilities it is desired to provide a layer of protective material between the user and the toilet seat or the toilet bowl. Such layer of protective material should be easily replaced for each user. The dilemma is further aggravated when a young child is the one in need of the facility. The child's parent is concerned with not only the cleanliness of the toilet seat but also the dryness. Another concern is whether there is toilet paper, and the condition of the toilet seat after the child uses the toilet, as most children are less concerned with their tidiness than the supervising adult. For these reasons, there has been an abundance of inventive creativeness in the art of toilet seat covers. A number of common sense approaches are given in the description of the prior art. We are aware of the following:

| U.S. Pat. No. | Issue Date | Inventor | TITLE |
|---|---|---|---|
| 1,745,223 | Jan. 28, 1930 | Light | TOILET SEAT COVER |
| 2,313,311 | Mar. 9, 1943 | Arter et al. | TOILET SEAT COVER |
| 3,851,341 | Dec. 3, 1974 | Aoyama | SANITARY TOILET SEAT COVER |
| 4,850,061 | Jul. 25, 1989 | Engel | FOLDED TOILET SEAT COVER |
| 4,887,321 | Dec. 19, 1989 | MacLean | SANITARY TOILET SEAT COVER |
| 6,073,274 | Jun. 13, 2000 | McQueen | SANITARY TOILET SEAT COVER |

Rose Light, in 1929, designed one of the first toilet seat covers that was patented. In U.S. Pat. No. 1,745,223 Light discloses a seat cover made of paper formed into a slip cover.

One of the first uses of adhesive to hold the toilet seat on was disclosed by Charles Arter and Samuel Peskind in U.S. Pat. No. 2,313,311. The added adhesive strips to a rectangular sheet having an elliptical center opening.

Aoyama, in U.S. Pat. No. 3,851,341 describes a sanitary toilet seat that is annular, and has an adhesive that has a low adhesion to itself and can be folded face to face. The center section is detachably secured to the front edge of the inner edge of the annulus.

In U.S. Pat. No. 4,850,061, Engel discloses in his patent a disposable toilet seat cover can be made of any light weight sheet such as paper, plastic material, or a combination thereof. Engel specifically mentions paper coated with plastic. He notes that disposable toilet seat covers usually define an elliptical ring, which has an outer dimension of the toilet seat and an inner dimension which permits uninterrupted bowel movement and urination. Engel's position is that known disposable toilet seat covers of the above mentioned types suffer from the considerable disadvantage that they are inconvenient to carry, awkward to place on the toilet and tend to slide off the toilet seat or become crumpled when the user moves. It is known to use toilet seat covers provided with a sticking mechanism in the form of small adhesive patches mounted on the bottom surface of the seat cover. Such patches are covered with matching pieces of wax paper which serve as a protective cover for the adhesive patches. The major disadvantage of such known toilet seat covers is that the user must turn them upside down in order to pull off all the protective covers to reveal the adhesive patches. Such patches are covered with matching pieces of wax paper which serve as a protective cover for the adhesive patches. This process is inconvenient and tedious. Ironically, Engel's invention is also elliptical in shape, and in his discussion of the difficulty in removing the wax paper from the adhesive he does not address the issue that the elliptical shape may be contributing to the difficulty in exposing the adhesive patches, because of the difficulty in aligning the peel such that the wax paper is pulled off in a straight line. Also, with respect to exposing the adhesive, the release properties of wax paper are relatively poor as compared to other release media, such as silicone, and the release would be much harder. Engel also points out that the toilet seat cover may also be provided with an inner portion, outlined by perforations or other detachable means and thus easily removable before use. The inner portion is circular.

U.S. Pat. No. 6,073,274, like U.S. Pat. No. 4,850,061, discloses the use of thin water proof layers, except in the case of this patent where both the top and the bottom have water proof layers.

U.S. Pat. No. 4,887,321 discloses a porous paper coated with a water repellent coating. The toilet seat cover is folded like an accordion and is suitable for being dispensed.

The prior art contains a wide range of sanitary toilet seat covers that are designed to prevent the user's skin from being directly exposed to the toilet seat.

The prior art fails to provide a simple configuration that may be easily folded and packaged to provide convenient portability for caregivers of children, while assuring an effective barrier against impurities and wetness which may be present on the toilet seat, and which is also disposable. Furthermore, the prior art fails to provide a sanitary toilet seat cover that is texturally a poor adherent, thereby minimizing the difficulty caused when there is incidental contact between the adhesive and the toilet seat cover material. The prior art fails short of providing a toilet seat cover that is soft and pliable and comfortable to the skin. The prior art generally discloses circular or elliptical inner sections, not an oval inner section, wherein an oval is more easily initiated and removed from the edge of an ovalled inner edge. Circular and elliptical inner sections are more likely to tear when removing than an oval section, because the apex is easy to dislodge and initiate. The prior art does not teach a center section that is soft enough to be used as a wipe, and absorbent enough that it can be used as a towel. The prior art furthermore does not teach the advantage of a towel having a protective barrier to keep the users hands clean. A further feature that is not addressed by the prior art is the propensity of adhesive fasteners to delaminate when peeled from the toilet seat, either leaving torn seat cover or adhesive residue.

SUMMARY OF THE INVENTION

The invention is an easy to fold sanitary toilet seat cover for preventing direct contact between an individual's skin and the top and the side surfaces of a toilet seat. When unfolded, the toilet seat cover is sufficiently large to not only cover the entire elongated toilet seat, but also cover the sides of the seat. The disposable toilet seat cover comprises an annulus that is comprised of a quilted multilayer sheet having a water impervious layer and an absorbent layer, a wipe that is a detachable inner oval section that provides an opening to the toilet, and an adhesive fastening means for temporarily securing the annulus to a toilet seat. The water impervious layer comprises a coated layer and/or a filmic layer. The wipe detaches from an inner ovalled edge of the annulus, and is functional as a sanitary wipe or towel. The quilted multilayer sheet is conformable and soft enough to be used as a wipe. The water impervious coated layer or filmic layer on the wipe acts as a protective barrier against the intrusion of water and bacteria, thereby preventing the user's hands from becoming soiled during use. The apex of the wipe is shaped so as to be suitable for initiating and propagating the detachment of the inner oval section, and the apex is easier to start than a comparable circular or elliptical inner section. The disposable toilet seat cover is normally packed as a rectangularly folded sheet, which if needed can easily be refolded. The annulus preferably has a polygonal perimeter, where the preferred polygon is a rectangle having a length that is approximately the length of an elongated toilet seat, and a width that is slightly wider than the width of a toilet seat. The rectangular shape enables the disposable toilet seat cover to be easily folded.

The adhesive fastening means is preferably covered with a release liner, which can be easily removed. The adhesive fastening means is preferably a pressure sensitive adhesive or double coated adhesive on a carrier that is normally a film, where one of the two adhesives is a laminating adhesive that attaches the carrier to the annulus, and the exposed adhesive is a pressure sensitive adhesive. The adhesive is selected to have minimal adherence to a toilet seat surface to ensure stability of the product in use while easily releasing and not depositing or leaving a residue on that toilet seat surface. The carrier reinforces the filmic layer and enables the use of a relatively higher tack adhesive to hold the disposable toilet seat cover in position. Also, the disposable toilet seat cover can be removed without delaminating the multilayer sheet. As previously stated, the multilayered sheet is quilted. Quilting is essentially a process of heavy embossing that produces a multilayered sheet having a waffled morphology. The waffled sheet has a three dimensional pattern, wherein portions of the pattern are raised and intervening portions are recessed. Quilting pre-bends the multilayer sheet, imparting softness and pliability, making it more conformable and softer on the skin. Quilting increases the overall surface area, which enhances the absorbency. The quilting makes the multilayer sheet somewhat spongy and improves the thermal insulation, so a to provide a measure of warm and comfort. A significant proportion of the surface is recessed and therefore out of contact range of the adhesive. The net effect is to impart release properties to the surface of the multilayer sheet, making the disposable toilet seat cover much less susceptible to becoming entangled or otherwise distorted due to incidental contact with the adhesive when it is exposed. Quilting also increases the z-dimension strength of the multilayer sheet making it much less susceptible to delaminating. Quilting alone can be sufficient to bond the filmic layer to the absorbent layer, analogous to a stapleless paper fastener. The absorbent layer can be comprised of one or more plies of a porous paper, or absorbent products, for instance nonwovens and those used in personal care absorbent products. Examples of the latter include infant diapers, adult incontinent pads, and feminine care products. Personal care absorbent products typically contain an absorbent core that includes superabsorbent polymer particles distributed within a fibrous matrix. Superabsorbents are water-swellable, generally water-insoluble absorbent materials having a high absorbent capacity for body fluids. The superabsorbent polymers (SAP's) in common use are mostly derived from acrylic acid. Other absorbent polymers are modified cellulose, modified lignocellulose, or modified polysaccharide. The modified polymer is a sulfated polymer such as sulfated cellulose, a sulfated lignocellulose, and a sulfated polysaccharide.

The adhesive fasteners are located on the sanitary toilet seat cover so that they come in contact with the toilet seat. The adhesive fasteners enable it to be easily attached to and removed from the toilet seat without leaving a residue. The adhesive may be printed or coated directly on the bottom side or may be applied in the form of a double-coated pressure sensitive tape with a release liner.

The annulus of the disposable toilet seat cover as previously stated has multiple layers, which provide both comfort and a barrier against impurities and wetness, which may exist on the toilet seat. These layers may include pulp tissue, nonwoven fabric, and/or film. These layers preferably disperse in water or are at least flushable. The filmic layer may also be water soluble or dispersible. The prior art teaches that a number of polymers are currently known to have various degrees of water susceptibility. For instance, various grades of polyvinyl alcohol, cellulosics, and polyethylene oxide are extrudable and water soluble. Polyacrylamide is also well known in the art. Examples of flexible water insoluble polymers are polyethylene, polyethers, propylene, polyamide, polyester, low syrenic styrene-butadienes, polyacrylates, polylactones, urethanes, polylactams, polyketals, polyacetals, nitriles, compounded nitrocellulose, compounded PVC, chlorinated polyethylene and polydienes (i.e. trans-polyisoprene). The topside of the toilet seat cover can be printed. The multilayer sheet can be comprised of an absorbent layer and a water impervious coated layer. The water impervious coating layer is formed by coating an absorbent layer with one or more of the polymer compositions herebefore identified as suitable as a filmic layer. Examples of suitable coatings that form water impervious coated layers are emulsions and dispersions of polymers, such emulsions of polyethylene, styrene butadiene, acrylics and polyvinyl chloride. Polyvinyl chloride is also well known to be an excellent film former as a sol. Additionally, the coating could be comprised of a water repellant material such as wax, or silicone or a similar hydrophobic material.

The disposable toilet seat cover can appropriately be printed, for instance in the case for children the preferred printing is a juvenile design providing aesthetic value.

Additionally, the disposable toilet seat cover can be fragranced and can contain antiseptic additives such as antimicrobial agents.

OBJECTS OF THE INVENTION

The principal object of the present invention is to provide a disposable sanitary toilet seat cover that is suitable for use with children for preventing direct contact between an individual's skin and the top and the side surfaces of a toilet seat.

Another object of the invention is to provide a disposable sanitary toilet seat cover having a quilted multilayer sheet having a water impervious coated layer or filmic layer and an absorbent layer, a wipe that is a detachable inner oval section that provides an opening to the toilet, and an adhesive fastening means for temporarily securing the disposable cover to a toilet seat.

A further object of this invention is to provide a disposable sanitary toilet seat cover having improved absorbency on the top-side, a place for residual moisture on the toilet seat to migrate, added thickness with improved thermal insulation and cushioning, and improved conformability, hand and drape.

BRIEF DESCRIPTION OF THE DRAWINGS

The foregoing and other objects will become more readily apparent by referring to the following detailed description and the appended drawings in which:

FIG. 6 is a bottom view illustrating the water impervious coating or filmic layer of the disposable toilet seat cover, wherein the water impervious coating or filmic layer has an adhesive means, which as shown are adhesive islets that are covered with a release liner.

FIG. 7 is a bottom view illustrating the water impervious coating or filmic layer of the disposable toilet seat cover, wherein the water impervious coating or filmic layer has an adhesive means, which as shown are adhesive strips that are covered with a release liner.

FIG. 8 is an enlarged partial cross-sectional view taken along sectional line 8-8 of disposable toilet seat cover shown in FIG. 6 illustrating the adhesive means, wherein the adhesive means is an adhesive coated on a quilted absorbent sheet having a water impervious coating layer.

FIG. 9 is an enlarged partial cross-sectional view taken along sectional line 9-9 of disposable toilet seat cover shown in FIG. 6 illustrating the absorbent sheet having a water impervious coating the adhesive means.

FIG. 10 is an enlarged partial cross-sectional view taken along sectional line 10-10 of disposable toilet seat cover shown in FIG. 7 illustrating the quilted absorbent sheet having a filmic layer.

DETAILED DESCRIPTION

Figure 1:
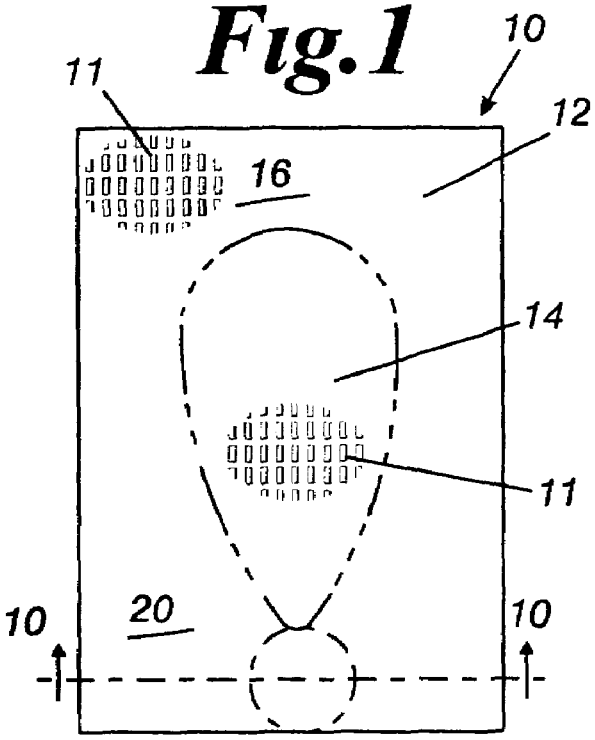
FIG. 1 is a plan view illustrating the absorbent layer of a disposable toilet seat cover which comprises a quilted multilayer sheet having a water impervious coating or filmic layer and an absorbent layer, wherein the quilted multilayer sheet has a detachable inner oval section. In this figure, the detachable inner oval section is shown attached. The tabs attaching the detachable layer are visually exaggerated to illustrate their existence.
Figure 2:
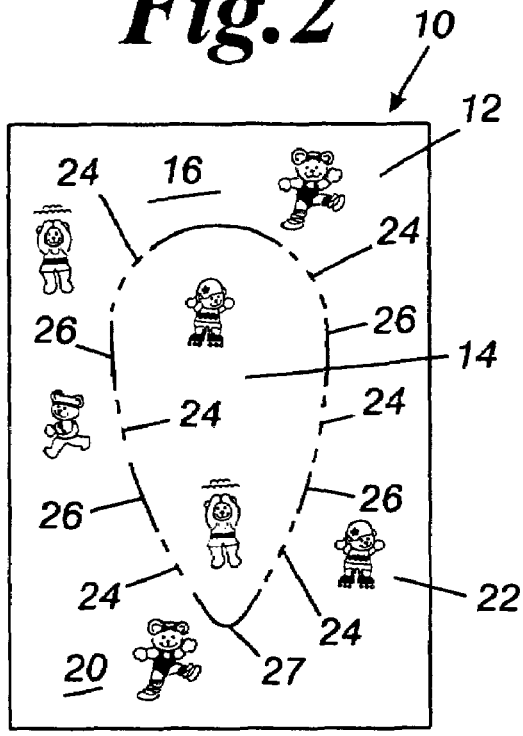
FIG. 2 is a top view of the disposable toilet seat cover shown in FIG. 1 illustrating a printed version, wherein the absorbent layer is printed with various Teddy bears. The absorbent layer is comprised of a nonwoven that is not quilted.
Figure 3:
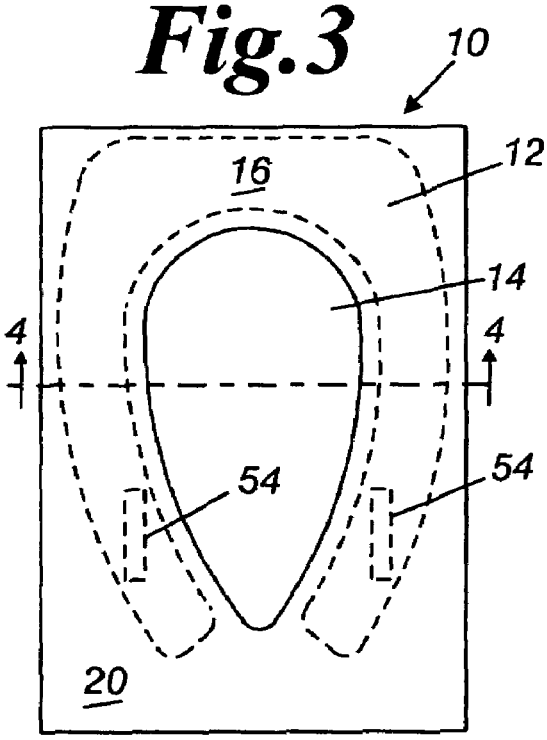
FIG. 3 is a top view of the toilet seat cover with the detachable inner oval section removed, illustrating how the invention is positioned on a toilet seat. The underlying toilet seat is shown in phantom.
Figure 4:
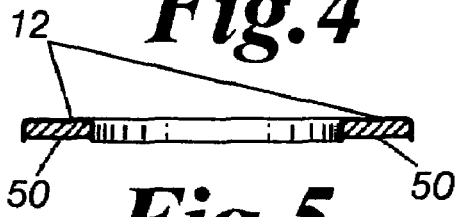
FIG. 4 is a cross-sectional view of the disposable toilet seat cover taken along line 4-4 of FIG. 3.

The invention is an easy to fold, disposable sanitary toilet seat cover 10 for preventing direct contact between an individual's skin and the top and the side surfaces of a toilet seat. The disposable toilet seat cover 10 as shown in FIGS. 1-13 comprises an annulus 12 that is a quilted multilayer sheet 20 having an absorbent layer 16 and a water impervious coated layer 42 or filmic layer 40, a wipe 14 that is a detachable inner oval section that provides an opening to the toilet, and an adhesive fastening means 54 for temporarily securing the disposable toilet seat cover 10 to a toilet seat 50. The wipe 14 detaches from an inner ovalled edge of the annulus 12. A top view of the disposable sanitary toilet seat cover 10 is illustrated in FIG. 1. The absorbent layer 16 is on the top-side of the annulus 12. The annulus has a perimeter that is polygonal, and more specifically rectangular. The polygonal annulus has a length that is approximately the length of an elongated toilet seat, and a width that is that is slightly wider that the width of a toilet seat. The quilted multilayer sheet 20 is pliable and soft enough to be used as a wipe. A partial view of the rectangular check quilt pattern 11 is shown in the corner of the annulus 12 and the wipe 14. The wipe 14 is perforatedly die cut from the multilayered sheet 20. Tabs 26 still retain the wipe 14 between slits 24. In FIG. 2, the multilayered sheet 20 is printed 22 with Teddy bears to make the disposable sanitary toilet seat cover 10 more appealing to children. FIG. 3 illustrates the invention on a toilet seat 50, which is shown in phantom by the dashed lines. The disposable sanitary toilet seat cover 10 is sufficiently large to not only cover the entire elongated toilet seat 50, but also cover the sides of the seat. A cross-sectional view of the annulus 12 on the seat 50, taken along sectional line 4-4 of FIG. 3 is shown in FIG. 4.

Figure 5:
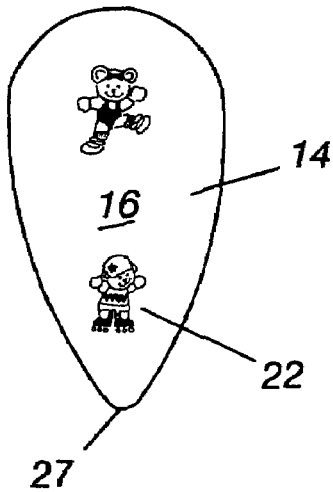
FIG. 5 is a plan view of the detachable inner oval section removed from the disposable toilet seat cover shown in FIG. 2. The detachable inner oval section is functional as a sanitary wipe or towel.

The wipe 14, detached from the disposable sanitary toilet seat cover 10 shown in FIG. 2, is shown in FIG. 5. The absorbent layer is comprised of a nonwoven that is not quilted. The wipe 14, like the annulus 12 has an absorbent layer 16 and a water impervious coated layer 42 or filmic layer 40 (not shown). The water impervious coated layer 42 or filmic layer 40 acts as a protective barrier against the intrusion of water and bacteria, thereby preventing the users hands from becoming soiled during use. The apex 27 of the wipe 14 is suitable for initiating and propagating the detachment of the wipe 14 from the annulus 12. The apex is easier to start than a comparable circular or elliptical inner section.

Figure 12:
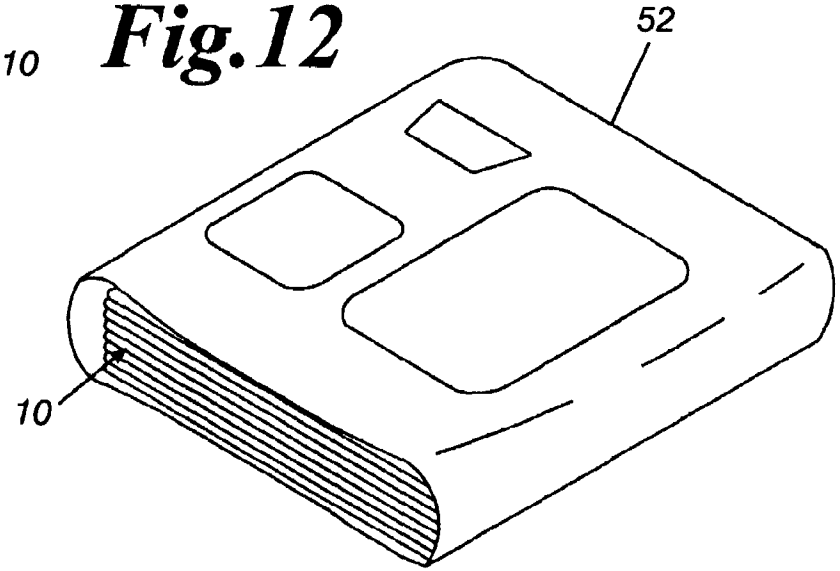
FIG. 12 is a perspective view of 8 folded toilet seat covers, packaged together in a plastic bag.
Figure 11:
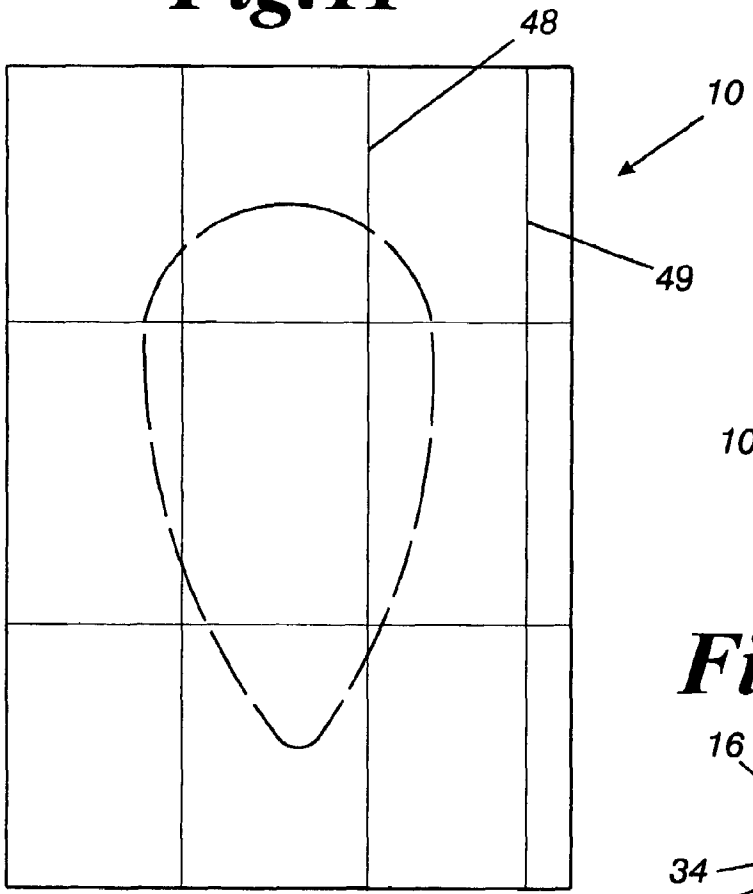
FIG. 11 is a plan view where the dotted lines illustrate how the disposable toilet seat cover can be rectangularly folded for packaging and carrying.

The disposable toilet seat cover 10 is normally packed as a rectangularly folded sheet, which if needed can easily be refolded. FIG. 11 illustrates a folding diagram for folding the toilet seat cover 10 along fold lines 48 into a rectangle so as to fit into the travel bag 52 as shown in FIG. 12. The fold lines are slightly off the centerline to allow for a finger lift fold 49. The invention is easily folded and packaged. FIG. 12 illustrates eight disposable toilet seat covers 10 packaged in a plastic carrying bag 52. The disposable sanitary toilet seat covers 10 shown in FIG. 12 are sold under the trademark Potty Toppers™, a product of Neat Solutions, Inc.

FIGS. 6 and 7 illustrate the bottom-side 18 of the annulus 12. A partial view of the rectangular check quilt pattern 13 is shown in the top and the bottom right corner of the annulus 12, as seen from the filmic side (bottom-side) of the disposable sanitary toilet seat cover 10. The bottom-side of the annulus 12. The adhesive fastening means 54 are illustrated as adhesive islets in FIG. 6, and as adhesive strips in FIGS. 3 and 7. The adhesive fastening means is a pressure sensitive adhesive 30 that is protectively covered with a release liner 36, which can be easily removed. Furthermore, the adhesive is selected to have minimal adherence to a toilet seat surface to ensure stability of the product in use while easily releasing and not depositing or leaving a residue on that toilet seat surface.

Figure 13:
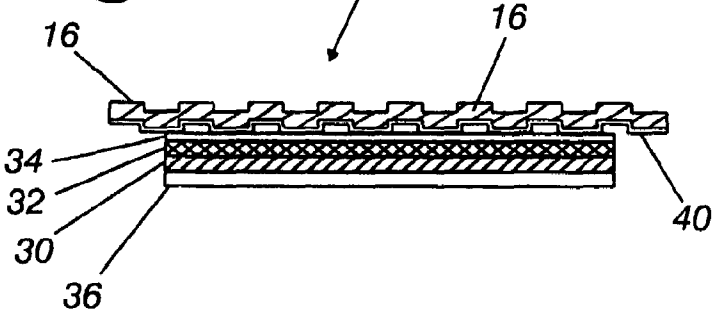
FIG. 13 is an enlarged partial cross-sectional view taken along sectional line 13-13 of disposable toilet seat cover shown in FIG. 7 illustrating a double coated adhesive on a carrier adhered to the bottom side of the quilted absorbent sheet having a filmic layer.

In FIG. 8, which is an enlarged partial cross-sectional view taken along sectional line 8-8 of the disposable toilet seat cover shown in FIG. 6, the adhesive 30 is coated on the water impervious coating layer 42. The adhesive is protected with release liner 36. The multilayer sheet 20 comprised of absorbent layer 16 and a water impervious coated layer 42 is quilted, having a rectangular check embossing. An enlarged partial cross-sectional view taken along sectional line 9-9 of annulus 12 is shown in FIG. 9. The rectangular quilting has raised areas 46 and intervening recessed regions 44 on both sides of the multilayer sheet 20. FIG. 13 illustrates an adhesive fastening means 54 that is a double coated adhesive on a carrier. FIG. 13 is an enlarged partial cross-sectional view taken along sectional line 13-13 of FIG. 7. The carrier 32 is laminated to the multilayer 20 by laminating adhesive 34. The carrier 32 is a film. Coated on the carrier is the adhesive 30, which is a pressure sensitive adhesive protected with release liner 36. The carrier adds strength to the multilayer sheet 20, making it less susceptible to delamination. FIG. 10 is an enlarged partial cross-sectional view of the quilted multilayer taken along sectional line 10-10 of FIG. 7. The rectangular quilting imparts raised areas 46 and intervening recessed regions 44 on both sides of the multilayer sheet 20. The filmic layer 40 is as heavily embossed as the absorbent layer 16, the net effect being an increase in the total surface area which improves absorbency on the top-side and creates a place for residual moisture on the toilet seat to migrate to, reducing the contact surface within range of the adhesive, adding thickness that improves the thermal insulation and cushioning, improving conformability which enhances hand and drape, and improving the z-dimensional strength.

Typically the absorbent layer 16 is a composite of multiple plies of a tissue, wherein the tissue is formed from paper and/or other nonwoven materials and fabrics. The quilting knits the plies together.

When unfolded, the toilet seat cover is sufficiently large to not only cover the entire elongated toilet seat 50, but also cover the sides of the seat. Further, the materials utilized in the disposable toilet seat cover 10 are preferably, but not necessarily, flushable in a toilet and dispersible in a septic system. Example 1 gives the properties of the illustrated embodiment.

EXAMPLE 1

The overall dimensions of the disposable sanitary toilet seat cover 10 are 16 inches×18.25 inches. The wipe, which is tear shaped, is 11.5 wide and 11.75 inches long. The absorbent layer 16 is comprised of a two ply paper tissue, each weighing 7.3 oz/sq yd, for a total weight of 14.6 oz/sq yd. The tissue has a tensile of 500 g/inch (MD) and 320 g/inch (CD). The absorbent layer 16 is laminated to a impervious coated filmic layer 40 comprised of 0.45 mil polyethylene film, which weighs 0.31 oz/sq yd. The polyethylene has an elongation of 450% (MD) and 800% (CD), and a tensile of 8000 lbs/cu in (MD) and 4100 lbs/cu in (CD). The quilted laminate weighs 15.0 oz/sq yd. The adhesive fastening means 54 is a double coated adhesive tape on a carrier 32, where the carrier is PET film. The release liner is a siliconized paper release liner. The tape is located 2 inches to 5 inches from the edge of the disposable sanitary toilet seat cover 10, as shown in ghost in FIG. 3. The toilet seat cover is folded to a 6 inch by 8 inch rectangle so as to fit into the travel bag 52 as shown in FIG. 12. The rectangle has a finger lift 49 that is a fold 1.25 inches from the perimeter edge to facilitate single cover removal from the bag.

SUMMARY OF THE ACHIEVEMENT OF THE OBJECTS OF THE INVENTION

From the foregoing, it is readily apparent that I have invented an improved disposable sanitary toilet seat cover that is suitable for use with children for preventing direct contact between an individual's skin and the top and the side surfaces of a toilet seat. Furthermore, the invention has a detachable wipe, an adhesive fastening means for temporarily securing the disposable cover to a toilet seat. The improved disposable sanitary toilet seat cover has added thickness with improved thermal insulation and cushioning, and improved conformability, hand and drape.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

We claim:

1. A disposable sanitary toilet seat cover for a toilet comprising:

an annulus having a polygonal perimeter and an opening that has a continuous ovalled inner edge with an apex, said annulus having a completely quilted patterned multilayer sheet comprised of a water impervious layer and an upper absorbent layer, wherein said absorbent layer is printed, wherein said water impervious layer comprises a coating layer or a filmic layer or both of a water resistant flexible polymer;

an inner oval section comprising a completely quilted patterned multilayer sheet having a water impervious lower layer and an absorbent upper layer attached to the lower layer, wherein the inner oval section is detachably attached to the inner edge of the annulus by perforations extending along the entire inner edge of the annulus;

the quilt pattern with raised areas on the water impervious layer that provide thermal insulation and cushioning, and intervening recessed regions on the absorbent layer that provide conformability to the toilet seat cover; and an adhesive fastening means temporarily securing the disposable cover to the toilet seat, wherein the adhesive fastening means is attached to the water impervious layer of the annulus.

2. The disposable toilet seat cover according to claim 1, wherein said filmic layer is comprised of polyethylene.

3. The disposable toilet seat cover according to claim 1, wherein said coating layer is comprised of an emulsion or dispersion of polyethylene.

4. The disposable toilet seat cover according to claim 1, wherein said adhesive fastening means is comprised of a pressure sensitive adhesive and a release liner.

5. A disposable toilet seat cover according to claim 4, wherein said adhesive fastening means is further comprised of a laminating adhesive and a carrier, wherein the laminating adhesive adheres the carrier to the water impervious layer, and the pressure sensitive adhesive is coated on the carrier.

6. The disposable toilet seat cover according to claim 1, wherein said quilt pattern is sufficiently pronounced to effect an increase of surface area, cushioning and absorbency of the absorbent layer.

7. The disposable toilet seat cover according to claim 5, wherein said adhesive fastening means are two or more islets.

8. The disposable toilet seat cover according to claim 5, wherein said adhesive fastening means are two or more strips.

9. The disposable toilet seat cover according to claim 5, wherein said absorbent layer is fragranced.

10. The disposable toilet seat cover according to claim 5, wherein said absorbent layer is comprised of one or more plies of porous tissue paper or nonwoven fibrous material, or a combination thereof.

11. The disposable toilet seat cover according to claim 10, wherein said absorbent layer is further comprised of water-swellable polymer particles distributed within a fibrous matrix.

12. The disposable toilet seat cover according to claim 1, wherein said polygonal annulus is a rectangle.

13. The disposable toilet seat cover according to claim 12, wherein said rectangle has a length that is approximately the length of an elongated toilet seat, and a width that is slightly wider than the width of a toilet seat.

14. The disposable toilet seat cover according to claim 13, wherein said multilayer sheet is folded to fit into a bag, and folded so as to create a finger lift (49) that facilitates single cover removal from the bag.

15. The disposable toilet seat cover according to claim 5, wherein said absorbent layer contains an antiseptic.

16. A disposable sanitary toilet seat cover comprising:

an annulus having a polygonal perimeter and an opening that has a continuous ovalled inner edge with an apex, said annulus having a completely quilted patterned multilayer sheet comprised of a lower filmic layer of a water resistant flexible polymer and an upper non-woven absorbent layer attached to the lower layer, wherein said absorbent layer is printed and comprised of a multiple ply tissue; an inner oval section comprising a completely quilted patterned multilayer sheet having a water impervious lower layer and an absorbent upper layer attached to the lower layer, wherein the inner oval section is detachably attached to the inner edge of the annulus by perforations extending along the entire inner edge of the annulus;

the quilt pattern with raised areas on the filmic layer that provide thermal insulation and cushioning, and intervening recessed regions on the absorbent layer that provide conformability to the toilet seat cover; and an adhesive fastening means for temporarily securing the disposable cover to the toilet seat, wherein the adhesive fastening means is attached to the filmic layer of the annulus and the adhesive fastening means is covered with a release liner.

17. The disposable toilet seat cover according to claim 16, wherein said multiple ply tissue is comprised of two or more plies of paper.

18. The disposable toilet seat cover according to claim 17, wherein said water resistant flexible polymer is comprised of polyethylene.

19. The disposable toilet seat cover according to claim 18, wherein said polygonal perimeter annulus is rectangular.

20. A disposable toilet seat cover according to claim 16, wherein said adhesive fastening means is comprised of a pressure sensitive adhesive, a laminating adhesive and a carrier, wherein the laminating adhesive adheres the carrier to the filmic layer.

21. The disposable toilet seat cover according to claim 16, wherein said adhesive fastening means are two or more islets.

22. The disposable toilet seat cover according to claim 16, wherein said adhesive fastening means are two or more strips.

23. The disposable toilet seat cover according to claim 16, wherein said absorbent layer is fragranced.

24. The disposable toilet seat cover according to claim 16, wherein said multiple ply tissue is comprised of two or more plies of the nonwoven material.

25. The disposable toilet seat cover according to claim 16, wherein said absorbent layer is further comprised of water-swellable polymer particles distributed within a fibrous matrix of the nonwoven.

* * * * *